US005436700A

United States Patent [19]

Kikuchi et al.

[11] Patent Number: 5,436,700

[45] Date of Patent: Jul. 25, 1995

[54] IMAGE FORMING APPARATUS WITH REMOVABLE PROCESS UNIT AND DEVELOPING DEVICE THEREOF

[75] Inventors: Kazuhiko Kikuchi, Yokohama; Minoru Yoshida; Takeshi Watanabe, both of Tokyo; Masao Yamaguchi, Kawaguchi; Kouji Hirano, Yokosuka, all of Japan

[73] Assignee: Kabushiki Kaisha Toshiba, Kawasaki, Japan

[21] Appl. No.: 124,197

[22] Filed: Sep. 21, 1993

[30] Foreign Application Priority Data

Nov. 26, 1992 [JP] Japan ..... 4-317481

[51] Int. Cl.[6] ..... G03G 15/00

[52] U.S. Cl. ..... 355/215; 355/210; 355/269; 355/308

[58] Field of Search ..... 355/210, 215, 259, 269, 355/270, 200, 308

[56] References Cited

U.S. PATENT DOCUMENTS

| | | | |
|---|---|---|---|
| 3,152,012 | 10/1964 | Schaffert . | |
| 4,561,766 | 12/1985 | Fox | 355/215 |
| 4,806,992 | 2/1989 | Yasuda et al. | 355/3 DD |
| 5,034,779 | 7/1991 | Newbury | 355/297 |
| 5,148,219 | 9/1992 | Kohyama | 355/269 X |
| 5,177,323 | 1/1993 | Kohyama | 118/653 |
| 5,227,843 | 7/1993 | Yamamoto et al. | 355/210 |
| 5,294,964 | 3/1994 | Oshiumi | 355/270 |
| 5,351,108 | 9/1994 | Mizutani | 355/215 |
| 5,359,394 | 10/1994 | Ogawa et al. | 355/215 |

FOREIGN PATENT DOCUMENTS

| | | | |
|---|---|---|---|
| 64-20587 | 1/1989 | Japan . | |
| 1-118878 | 5/1989 | Japan . | |
| 2-281268 | 11/1990 | Japan | 355/210 |
| 4-267282 | 9/1992 | Japan | 355/269 |

*Primary Examiner*—Joan H. Pendegrass
*Attorney, Agent, or Firm*—Foley & Lardner

[57] ABSTRACT

A printer comprises a removable process unit which includes a photoconductive drum and an image forming section for forming an image on the drum. The process unit is provided with a removing member for removing dust from a transfer medium adhering to an aligning roller and a dust storage section for storing the dust removed by the removing member. The storage capacity of the dust storage section is larger than a capacity equivalent to the volume of the dust removed as the transfer medium corresponding in quantity to the service life of the process unit is processed.

13 Claims, 8 Drawing Sheets

IMAGE FORMING APPARATUS WITH REMOVABLE PROCESS UNIT AND DEVELOPING DEVICE THEREOF

BACKGROUND OF THE INVENTION

1. Field of the Invention

The present invention relates to a developing device for visualizing an electrostatic latent image and an image forming apparatus, such as an electrophotographic apparatus or electrostatic recording apparatus, furnished with the developing device, and more particularly, to an image forming apparatus and a developing device thereof, capable of prolonged maintenance of high-quality images produced by means of a one-component developing agent or by using a cleanerless process.

2. Description of the Related Art

In general, if a predetermined amount of paper dust (or dust) or more from a transfer medium is introduced into a developing unit, electric charge on a developing agent is lowered, so that the transfer medium with an image thereon is inevitably subject to ground fogging and irregular image density.

In a developing unit using a one-component developing agent, as compared with one for two-component developing, in particular, the developing agent does not contain a carrier or electrifying material which frequently touches a toner. Therefore, the developing agent must be electrified by seizing only one chance to be put strongly, which greatly influences the invasion of the paper dust. In contact developing, above all, a developing roller is in contact with an electrostatic latent image bearing member (hereinafter referred to as photoconductor), so that the probability of the paper dust straying into the developing unit is high.

Further, the probability of the invasion of the paper dust varies depending on the presence of cleaning means for the photoconductor and the method of cleaning. A two-revolution-for-one-copy process in a cleanerless copying machine and a cleanerless process in a printer are highly susceptible to the paper dust invasion.

Conventionally, in order to prevent the paper dust invasion, dust removing means, such as a fiber brush or Mylar, is brought into contact with a pair of rollers arranged in the middle of a path along which the transfer medium is transported to the photoconductor, so that the paper dust is removed from the rollers by the removing means.

When some of the paper dust is removed so that the fiber brush is saturated with the dust, however, a further effect of paper dust removal cannot be expected of the brush. Although Mylar cannot be saturated with the removed paper dust, it ceases to be able to remove the paper dust if gaps are formed between its contact surface and the roller surfaces due to fine scratches caused by the frictional contact with the rollers.

These problems, which depend on the life of the paper dust removing means, can be solved by only changing the removing means at regular intervals. Actually, however, it is troublesome for a user or serviceman to replace the removing means only. In many cases, therefore, the removing means is fixed to the apparatus body, and a developing device, cleaning device, or toner is improved, instead, to tackle the situation.

As a technique for the cleanerless process, an arrangement for the miniaturization of an image forming apparatus is described in, for example, Jpn. Pat. Appln. KOKAI Publication No. 47-11538. According to this arrangement, the apparatus can be reduced in size by using a unit which combines as a developing device and a cleaning device. In this arrangement, an electrostatic latent image is developed by means of a single developing device as a photoconductive drum passes the developing device for the first time, and a memory image on the drum is removed after transfer operation as the drum passes the developing device for the second time.

However, the memory image is removed after the photoconductive drum starts to pass the developing device for the second time, so that the recording speed is inevitably reduced by half, and a recording area wider than the outer peripheral surface of the drum cannot be obtained. Naturally, therefore, the photoconductive drum requires a relatively large size, so that the apparatus cannot be made small enough.

Described in U.S. Pat. No. 364,926, on the other hand, is a technique for eliminating drawbacks related to speed. This technique uses a developing device which simultaneously develops an electrostatic latent image and removes a developing agent remaining on a photoconductive drum after the preceding transfer cycle as the drum passes for the first time.

A pressurized developing method is known as one of the developing methods which use a one-component developing agent. This method is characterized in that an electrostatic latent image and a toner carrying body (hereinafter referred to as developing roller) are rotated in contact with each other at a relative peripheral speed of approximately zero (as described in U.S. Pat. No. 3,152,012, Jpn. Pat. Appln. KOKAI Publications Nos. 47-13088 and 47-13089, etc.), and has many advantages. Since this method does not require use of any magnetic material, for example, the apparatus can be simplified in construction and reduced in size, and color toners can be used with ease.

In the pressurized developing method described above, developing operation is performed with the developing roller pressed against or in contact with the latent image, so that the developing roller must have elasticity and electrical conductivity. If the photoreceptor is a rigid body, in particular, it is essential to use the elastic developing roller so as to prevent damage to the photoreceptor.

In order to obtain the well-known developing electrode effect and bias effect, it is desired that a conductive layer be provided on or near the surface of the developing roller so that a bias voltage can be applied as required. Since the photoconductive drum and the developing roller are in contact with each other, according to this method, however, it is inevitable that paper dust from transfer paper will be introduced. Since the one-component developing agent, unlike a two-component developing agent, does not contain a carrier, a material for continually frictionally charging the toner, moreover, insufficient electrification attributable to the paper dust has a great influence, resulting in reduction of the electric charge on the toner.

In the cleanerless process, as described above, the next cycle for electrification, electrostatic latent image formation, and developing is carried out with the after-transfer memory image remaining on the photoconductive drum. In the electrifying operation, therefore, the remaining latent image and toner image are electrified superposed, and this toner image is subjected to the next image exposure. Thus, uniform electrification and latent image formation are hindered, and the memory image from the preceding stage appears superposed on the next picture, so that the resulting image is not clear.

This phenomenon is liable to occur particularly when a solid region (in which the developing agent adheres to a wide area) meets with the memory image, such as characters, formed in the preceding stage, so that the developer image, as well as the latent image, often cannot be removed thoroughly. In some cases, therefore, the developer image remains as a memory, and is transferred directly to the paper.

Thus, the conventional recording apparatus cannot enjoy a satisfactory reliability, often failing to produce clear images.

As the paper dust transferred from the transfer medium to the photoconductor accumulates on developer disturbing means, moreover, memory images may be produced even though the capability of the residual toner to become patternless is lowered. Also, the paper dust may be caused to drop from the disturbing means onto the photoconductor or the transfer medium transportation path by vibration produced during emergency operation, such as the removal of jamming, actuation of the photoconductor, etc., thereby entailing irregular electrification and exposure.

SUMMARY OF THE INVENTION

The present invention has been contrived in consideration of these circumstances, and its object is to provide an image forming apparatus capable of producing high-quality images free of irregular density, ground fogging, etc. and maintaining good image quality after prolonged use, and a developing device used in this image forming apparatus.

In order to achieve the above object, an image forming apparatus according to the present invention comprises a removable process unit including an image bearing member and image forming means for forming an image on the image bearing member. This process unit is provided with removing means for removing dust from a transfer medium adhering to transporting means and collecting means for collecting the dust removed by the removing means. The storage capacity of the collecting means is larger than a capacity equivalent to the volume of the dust removed as the transfer medium corresponding in quantity to the service life of the process unit is processed.

According to the present invention, moreover, the transporting means includes an electrically conductive roller, and the removing means includes an electrically conductive separating member in contact with the roller. Further, there is provided means for applying a bias voltage to the roller.

According to the image forming apparatus constructed in this manner, the removing means and the collecting means for collecting the paper dust removed by the removing means are provided at the process unit, so that the dust removing capability is improved, and the removing means can be automatically replaced with a new one when the process unit is changed. The storage capacity of the collecting means is made larger than the capacity equivalent to the volume of the paper dust removed from paper sheets of the number corresponding to the service life of the unit, so that all the dust removed by means of the removing means can be stored within the set life of the unit. By applying the bias to the removing means through the roller of the transporting means, moreover, the dust removing capability can be improved, and no special power supply member is required, thus resulting in reduction in cost.

Also, the image forming apparatus according to the invention comprises shutter means for closing the collecting means when the process unit is removed. In this case, the dust recovered in the collecting means can be prevented from being scattered to the outside when the unit is attached or detached.

Further, the image forming apparatus according to the invention comprises means for disordering the residual developing agent on the image bearing member patternless by coming into sliding contact therewith after the image visualized by developing means is transferred to the transfer medium by the transfer means, and developer receiving means for receiving the developing agent scraped off as the image disturbing means comes into sliding contact with the image bearing member.

Furthermore, the image forming apparatus comprises means for removing the dust from the transfer medium adhering to the image bearing member by coming into contact with the image bearing member in a position between the disordering means and the transfer means.

According to the image forming apparatus constructed in this manner, the developing agent disturbed and dropped by means of the disordering means is received by the developer receiving means. Thus, the dropped developing agent can be prevented from scattering and soiling the apparatus. Further, the dust transferred from the transfer medium to the surface of the image bearing member can be efficiently seized by means of the removing means.

A developing device according to the present invention comprises a storage section stored with a developing agent, developing means for supplying a developing agent to an image bearing member, developer supply/recovery means for supplying the developing agent from the storage section to the developing means and recovering the developing agent remaining on the developing means after an image is developed by the developing means, separating means abutting against the developer supply/recovery means, for separating the developing agent recovered by the developer supply/recovery means and dust from the developer supply/recovery means, and a recovery path through which the separated developing agent and dust are guided to the storage section.

The storage section contains stirring means for supplying the developing agent therein to developer supply/recovery means and stirring the developing agent and the dust, recovered through the recovery path, along the axial direction of the developer supply/recovery means. According to the image forming apparatus constructed in this manner, the developing agent and toner separated from the developer supply/recovery means by the separating means is recovered into the developer storage section through the recovery path. Thus, the separated dust can be fully blended with the developing agent by means of the stirring means, without being moved immediately to the developer supply/recovery means, so that the influence of the dust can be minimized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 15 show a printer according to an embodiment of the present invention, in which:

FIG. 1 is a sectional view of an image forming section including a process unit;

FIG. 2 is a sectional view of a developing device;

FIG. 4 is a front view showing the separating grid along with part of the developing device;

FIG. 5 is a graph showing the developing characteristic of the developing device;

FIG. 6 is a timing chart illustrating sequences for bias applied to the developing device;

FIG. 7 is a perspective view showing a stirrer of the developing device;

FIG. 8 is a sectional view of a disturbing member of the process unit;

FIG. 9 is an enlarged schematic view showing a paper dust seizing member and the disturbing member of the process unit;

FIG. 10 is a graph showing the relationship between the width of the paper dust seizing member and the amount of seized paper dust;

FIG. 12 is a graph showing differences in developer fogging depending on the types of paper on which images are formed by means of the process unit;

FIG. 13 is a schematic view showing a suction-type charge measuring device for measuring electric charge on a toner on a developing roller of the process unit;

FIG. 14 is a sectional view showing a state in which a paper dust removing member and a shutter member are in contact with an aligning roller; and FIG. 15 is a sectional view showing a state in which the paper dust removing member and the shutter member are separated from the aligning roller.

DETAILED DESCRIPTION OF THE PREFERRED EMBODIMENT

An embodiment of the present invention will now be described in detail with reference to the accompanying drawings.

Figure 1:
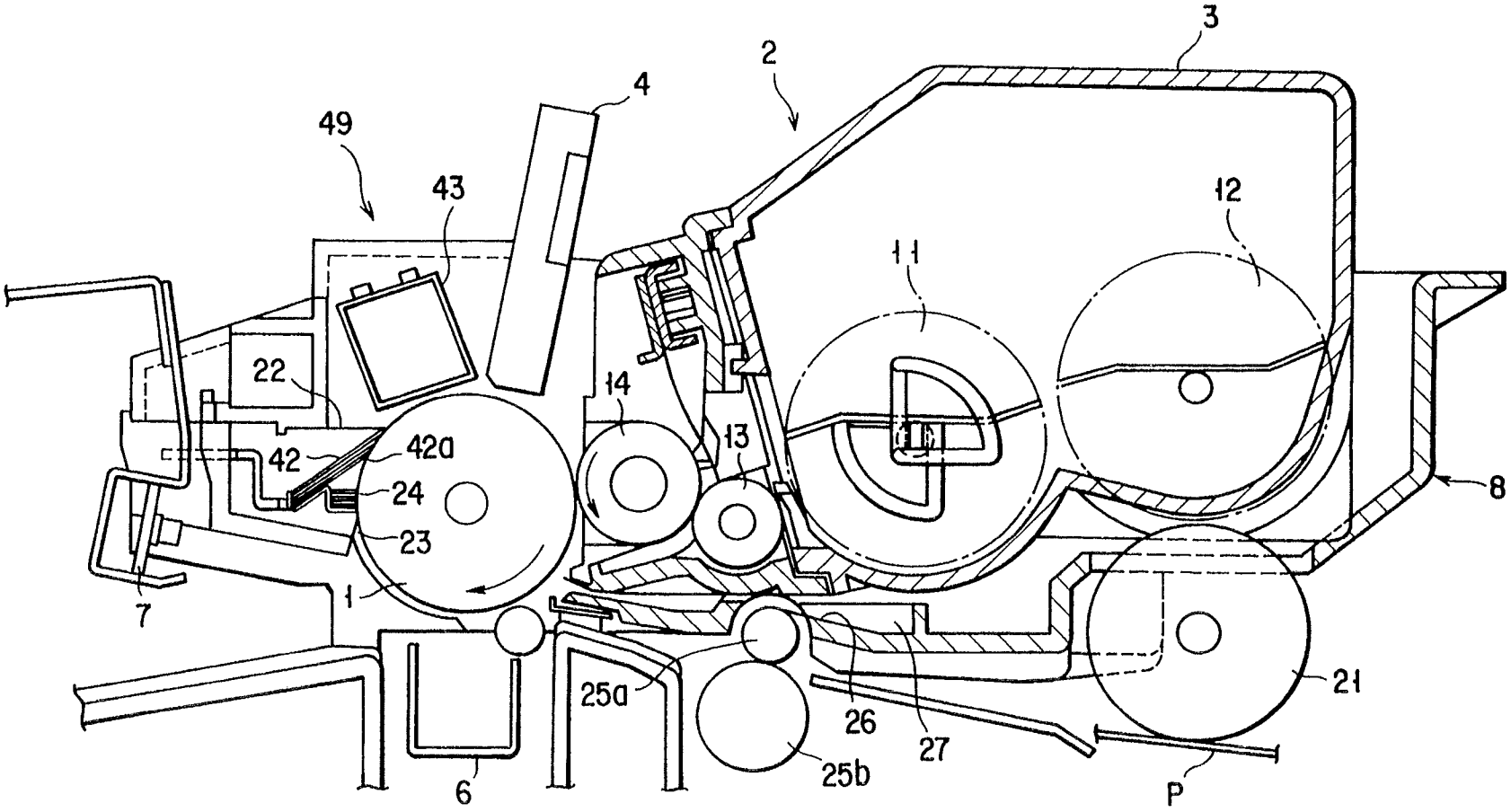

FIG. 1 shows an image forming section of a printer according to the present embodiment. The image forming section comprises a process unit 8 in which a developing device is used in a developing/cleaning (cleanerless) process. The unit 8 is removably mounted in the body of the printer.

A photoconductive drum 1 for use as an image bearing member, which has a recording surface narrower (or smaller in diameter) than an image to be recorded, is located substantially in the center of the process unit 8, for rotation in the direction of the arrow. The drum 1, which has a diameter of 30 mm, is formed of a photoconductive material based on an organic photoconductor (OPC). The photoconductive drum 1 is surrounded by several elements of the image forming section 49, including a sconotron charger 43, EL (edge emitter array) 4 for use as latent image forming means, developing/cleaning device 2, transfer charger 6, de-electrifier 7, and developer disturbing member 42, which are successively arranged in the rotating direction of the drum. Since the cleanerless process produces no waste toner, the process unit can be reduced in size.

The outer circumferential surface of the photoconductive drum 1 is uniformly electrified to −500 V by means of the sconotron charger 43, and the electrified region is exposed depending on the image density by means of the EL 4. By doing this, an electrostatic latent image is formed on the surface of the photoconductive drum 1, whereupon the developing/cleaning device 2 is reached.

The latent image forming means is not limited to the EL, and may be formed of a liquid-crystal shutter or an LED or some other light source.

The developing/cleaning device 2 develops the electrostatic latent image while removing the residual toner after transfer. A developing bias of −200 V is applied normally. At the start of rotation of the photoconductive drum 1, however, a bias of +100 V is applied in the manner mentioned later, in order to prevent adhesion of the toner. A developed toner image on the drum 1 is transported to a transfer region. In this transfer region, paper P, for use as a transfer medium, is fed from a paper feeding unit (not shown) as a paper-supply roller 21 in synchronism with the rotation of the drum 1. Then, the toner image on the surface of the photoconductive drum 1 is electrostatically attracted and transferred to the paper P by the transfer charger 6. After receiving the toner image, the paper P is transported to a fixing device (not shown), whereupon it is fixed to the paper P with heat and pressure, and the paper P is then discharged to the outside of the apparatus body.

The following is a detailed description of the developing/cleaning device 2.

Figure 2:
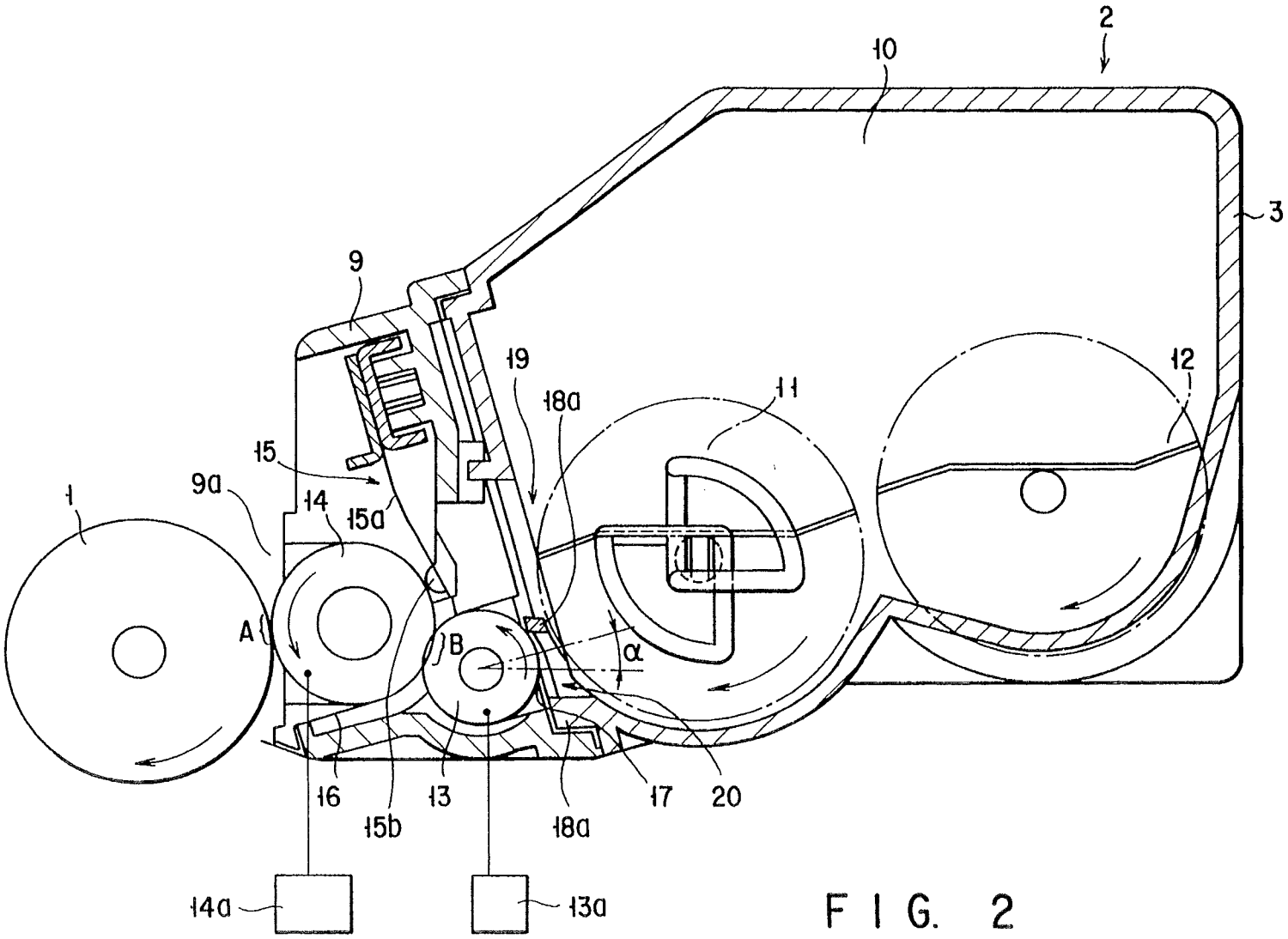

As shown in FIGS. 1 and 2, a developing/cleaning device 5 comprises a developing container 3. A casing 9 is removably attached to the front portion the container 3. The casing 9 contains a developing roller 14 which faces an opening 9*a* in the casing. The roller 14 is in rolling contact with the photoconductive drum 1 through the opening 9*a*. Also, the roller 14 is connected to a developing bias source 14*a*. A hopper 10, for use as a developer storage section, is disposed in the developing container 3. The hopper 10 contains the toner, for use as a one-component developing agent, and stirrers 11 and 12 for stirring the toner.

Further, an intermediate roller 13, for use as toner supply/recovery means, is in rolling contact with the other side portion of the developing roller 14. The intermediate roller 14 serves to supply the toner to the developing roller 14 and also to separate the toner from the surface of the developing roller 14.

A bias source 13a is connected to the intermediate roller 13 so that a bias from the source 13a is applied to the roller 13. As compared with the developing bias of −200 V, the intermediate roller bias is controlled so as to be at −270 V in a toner supply mode and at 0 V (GND) in a separation mode.

Furthermore, a layer forming blade 15 for forming a uniform-thickness toner layer on the outer circumferential surface of the developing roller 14 is in contact with the roller 14.

During developing operation, the toner in the hopper 10 is continually stirred by means of the stirrers 11 and 12, and is fed to the intermediate roller 13. As the roller 13 is rotated, the toner delivered to the region nearby is fed onto the surface of the developing roller 14. As the roller 14 is rotated, the toner on its surface reaches the layer forming layer 15. Thereupon, the toner is fully negatively electrified through frictional charging between the developing roller 14 and the blade 15 as it is leveled into a thin layer, and is then transported to a developing region A. In this region A, the developing roller 14 comes into contact with the photoconductive drum 1 with the thin toner layer and a predetermined nip between the two.

By the time of this process, the electrostatic latent image is already formed on the photoconductive drum 1 by the image forming means (mentioned later), providing a potential of −350 to −800 V at a no-image portion of the drum and a potential of about −60 V at an image portion. The electrostatic latent image on the drum 1 is reversely developed by means of the thin toner layer on the developing roller 14 as it passes the developing region A. At this time, that portion of the toner layer which has passed the developing region A without being used for the developing is scraped from the developing roller 14 by means of a recovery blade 16, and is recovered in the developing container 3. Thereupon, a nip B between the intermediate roller 13 and the developing roller 14 is reached.

The intermediate roller 13 is an electrically conductive or semiconductive sponge roller. In the case where the supply-mode bias (−270 V) is applied to the intermediate roller 13, the negatively electrified toner is subjected to an electrical force such that it is pressed against the developing roller 14 by the roller 13. In the supply mode, therefore, only a mechanical force which is produced by the rotation of the intermediate roller 13 against the developing roller 14 (with a peripheral speed difference) at the nip B serves to peel the toner from the nip portion of the roller 14. Thus, hardly any part of the toner on the developing roller 14 is transferred to the intermediate roller 13.

In the case where a recovery-mode bias (0 V) is applied to the intermediate roller 13, on the other hand, the toner on the developing roller 14 is transferred to the roller 13 by the mechanical peeling force of the intermediate roller 13 and an electric field formed between the rollers 14 and 13. The wider the nip B, the greater the force to peel the toner from the developing roller 14 is.

According to the present embodiment, it is ascertained that the toner can be satisfactorily peeled off if the depth of bite between the developing roller 14 and the intermediate roller 13 is 0.25 mm or more in the case where the diameters of the rollers 14 and 13 are 18 mm and 12 mm, respectively.

If the depth of bite between the intermediate roller 13 and the roller 14 is too great, these rollers may be damaged, and the necessary torque for the drive of the developing unit may increase. The proper depth of bite ranges from 0.25 to 2 mm. The toner transferred to the intermediate roller 13 is peeled from the roller 13 by a separating grid 17 for use as developer separating means, and is then returned to the hopper 10.

The toner used was formed by mixing polyester resin with carbon, an electrification control agent, and wax by kneading, and then adding 1% of silica to the resulting material. In general, the developing roller 14 may be formed of an elastic roller having a resistance of $10^2$ to $10^8$ Ω.cm, rubber hardness of 25 to 60 degrees (JIS-A), and surface roughness of 1 to 8 μm or thereabout. According to the present embodiment, the developing roller 14 was formed by depositing a surface layer of 40-μm thickness on the surface of an electrically conductive urethane rubber base having rubber hardness of 36 degrees and resistance of $10^3$ Ω.cm. The surface layer was formed by dipping the urethane rubber base in a dispersion of the electrification control agent in a urethane-based paint.

Urethane sponge having a resistance of $10^4$ to $10^5$ Ω.cm and cell number of 80/inch was used for the intermediate roller 13.

The layer forming blade 15 for forming the thin toner layer on the developing roller 14 was formed by mounting a silicon rubber chip **15*b* (2.5 mm in radius) on a stainless-steel sheet (SUS304CSP) 15*a* with a thickness of 0.12 mm. The material of the rubber chip 15*b*** must be selected from materials which negatively electrify the toner.

Figure 3C:
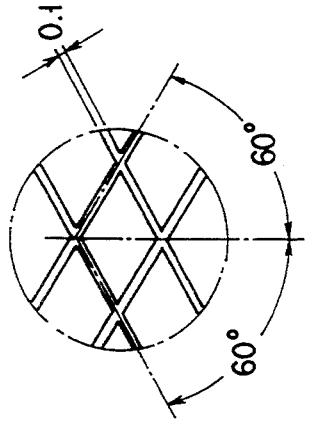
FIG. 3C is a plan view corresponding to FIG. 3B, showing a modification of the meshes.
Figure 3B:
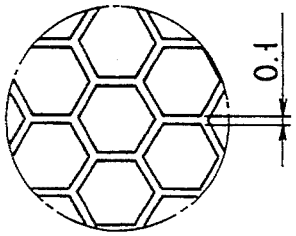
FIG. 3B is an enlarged plan view showing some meshes of the separating grid.
Figure 3A:
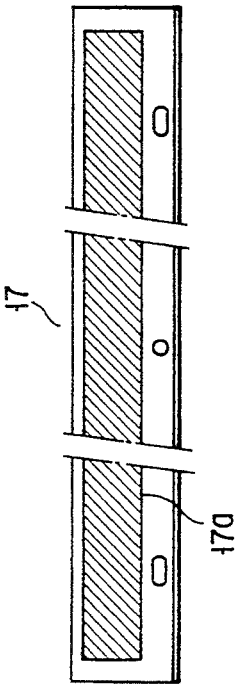
FIG. 3A is a plan view showing a separating grid of a developing device.

Further, the separating grid 17 is a stainless-steel sheet with a thickness of 0.15 mm, such as the one shown in FIG. 3A. Meshes of grid 17 were caused to engage the intermediate roller 13 with a bite of about 0.5 mm. If the separating grid 17 is too thin, it cannot bite into the intermediate roller 13. If the grid 17 is too thick, on the other hand, the driving torque of the roller 13 increases. Therefore, the grid thickness should be set within a certain range. A satisfactory result was obtained when the thickness was within a range of 0.1 to 0.3 mm.

Figure 4:
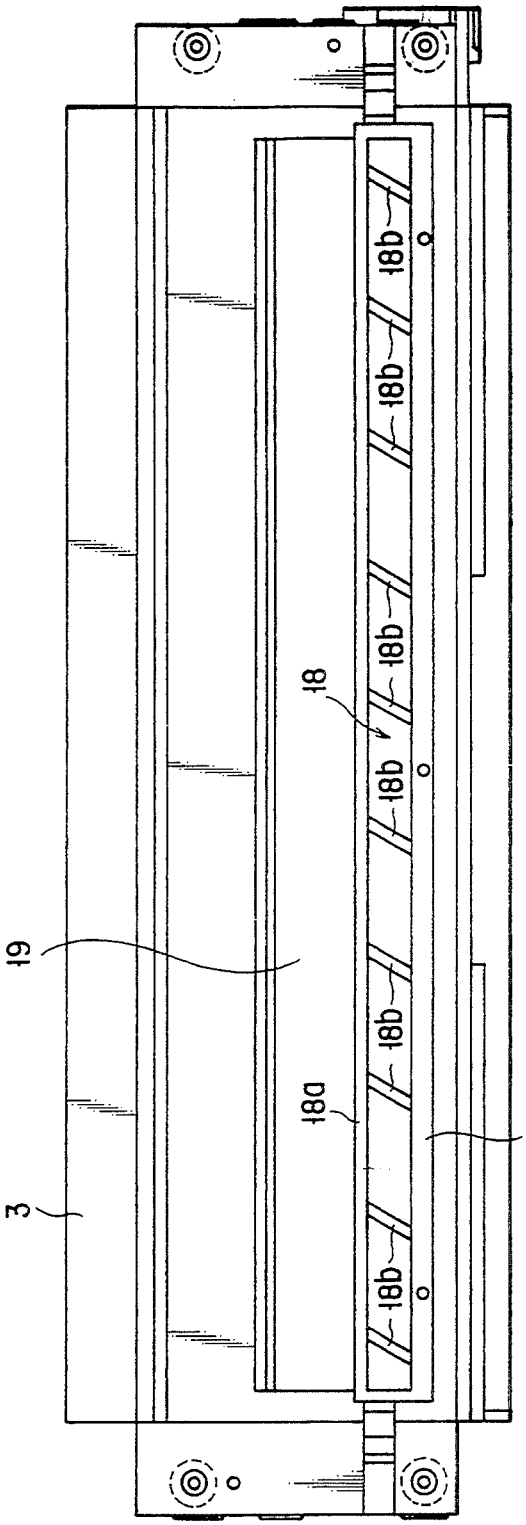

A meshed opening 17a of the separating grid 17 is hexagonal or rhombic, as shown in FIG. 3B or 3C. The grid 17 is supported at both sides of the region for the engagement with the intermediate roller 13, and a plurality of reinforcing ribs **18*b* are arranged between its supporting portions 18*a*, as shown in FIG. 4. Thus, the supporting portions 18*a* are composed of an aggregate of openings 18 situated between the adjacent ribs 18*b*, so that they can enjoy intimate contact with the intermediate roller 13** and provide a satisfactory separation effect.

Further, the reinforcing ribs **18*b* are inclined at an angle to the axis of the intermediate roller 13, and are not contact with the meshed opening 17*a*. Therefore, the toner separated from the roller 13 can be delivered to the hopper 10** without being dammed up.

The developing device 5, constructed in this manner, was set in the printer, and printing tests were conducted.

Under the condition that the surface potential of the photoconductive drum 1 and the developing bias are at −450 V and −200 V, respectively, the developing roller 14 rotates in the same direction (with-direction) as and at the peripheral speed 1.6 times that of the drum 1, at the developing nip. A voltage of −270 V is applied as the intermediate roller bias, and the toner is fed from the intermediate roller 13 to the developing roller 14, urged by the potential difference between the intermediate roller bias and the developing bias. Thus, the image density cannot be lowered even when a solid image is printed continuously.

Figure 5:
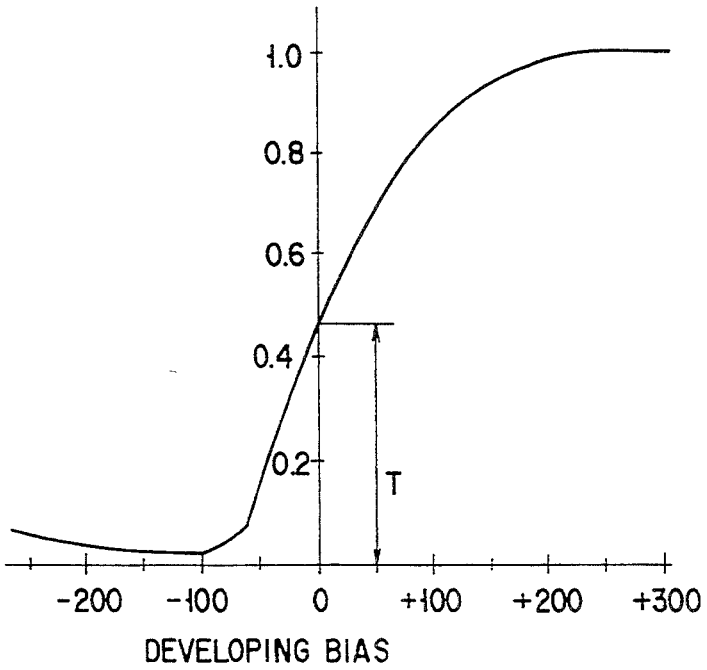

The contact-type one-component developing process according to the embodiment described above has a developing characteristic shown in FIG. 5. Even if the photoconductive drum 1 has the same potential as the developing bias, therefore, the toner inevitably adheres to the drum 1.

When the power is turned on or in case of jamming, for example, electric charge on the photoconductive drum 1 dissipates during processes from electrification to developing, and the surface potential is reduced to 0 V or becomes very low. Inevitably, therefore, a good amount of toner adheres to the drum 1, as seen from the aforementioned developing characteristic curve, even though the developing bias is reduced to 0 V to prevent the toner from being used for the developing while the unelectrified region of the photoconductive drum 1 passes during the processes from electrification to developing.

If the toner thus adheres to the photoconductive drum 1 at the start of rotation of the drum, the toner consumption inevitably increases. If a contact transfer device, such as a transfer roller, is used, moreover, it is stained, thereby soiling the paper. In order to prevent the adhesion of the toner at the start of rotation of the photoconductive drum 1, an opposite-polarity developing bias (at about +100 V) is applied to the developing roller 14 before the nip region B is passed, and a normal bias potential of −200 V is applied after the region B is passed.

Figure 6:
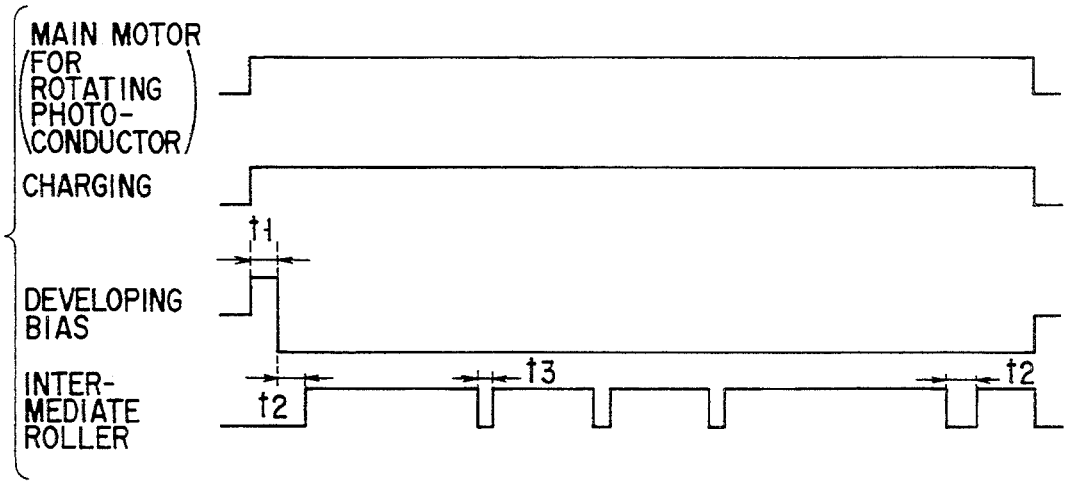

In a normal printing mode, the intermediate roller bias of −270 V is applied so that an electric field in the direction to supply the developing roller 14 is formed. During initializing operation after power-on operation, print starting operation, print terminating operation, intervals between printing cycles for individual paper sheets, however, the bias potential is reduced to 0 V, thereby electrically separating the toner on the developing roller 14 from the intermediate roller 13 (whereupon a toner recovery mode is started). FIG. 6 shows timing sequences for the developing bias, covering the toner adhesion prevention and recovery mode.

In FIG. 6, t1 is a time for the application of the adhesion prevention bias between the start of rotation of the photoconductive drum 1 and the electrification, t2 is a time difference between the start and termination of the printing operation, and t3 is a toner recovery time corresponding to the paper interval.

Thus, by controlling the bias potential for the intermediate roller 13 so that the toner is transferred from the developing roller 14 to the intermediate roller 13, the toner on the roller 14 can be continually refreshed even when a document with a high white-ground ratio is printed. Thereafter, the toner on the surface of the intermediate roller 13 is separated by means of the separating grid 17, and delivered to the hopper 10. The toner is stirred by means of the stirrer 11 in the hopper 10 as it is fed again to the intermediate roller 13.

Figure 7:
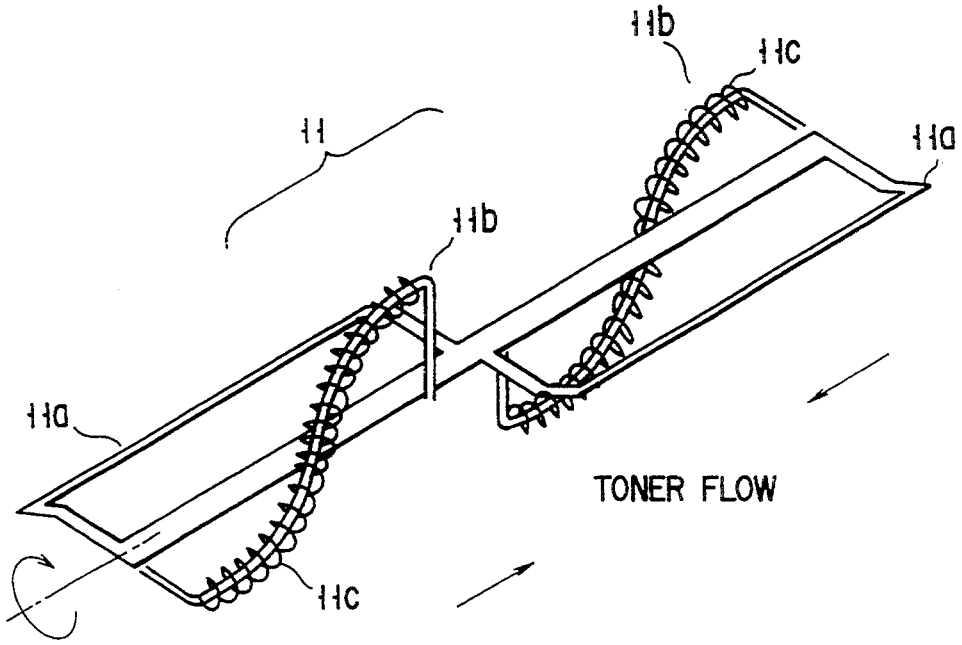

As shown in FIG. 7, the stirrer 11 comprises toner supply portions 11a for supplying the toner mainly to the intermediate roller 13 and spreading auger portions 11b for moving the toner mainly in the longitudinal direction. The supply portions 11a serve for efficient use of the toner in the hopper 10 (in order to minimize dead toner) and safe toner supply. The auger portions 11b are used to mix the toner separated from the intermediate roller 13 and the toner in the hopper 10.

It is essential to minimize the capability of the spreading auger portions 11b for the toner supply to the intermediate roller 13. If the supply capacity of the auger is relatively high, the toner may possibly be supplied to the intermediate roller 13 before the toner separated from the roller 13 is spread. In the present embodiment, each spreading auger portion 11*b* is composed of a coil spring 11*c* which forms a spiral around an axis of rotation substantially parallel to the intermediate roller 13. The toner supply portions 11a are in the form of pedals which are divided in the middle of the stirrer 11 with respect the axial direction thereof so that the toner is fed once with every revolution, thus producing a good spreading effect.

The toner separated from the intermediate roller 13 by means of the separating grid 17 returns to the hopper 10 through a recovery path 20 in which the grid 17 is located. The toner transported to the intermediate roller 13 by the stirrer 11 passes through a regular path 19 which is formed over the recovery path 20. Accordingly, it is essential to prevent the separated toner from being immediately transported to the intermediate roller 13 by the stirrer. In the present embodiment, therefore, the casing 9, which holds the developing roller 14, intermediate roller 13, and layer forming blade 15, and the hopper 10, which contains the stirrers 11 and 12, are separable from each other. The separating grid 17 is supported on the hopper 10 by means of the openings 18, which constitute the recovery path 20 through which the toner separated from the intermediate roller 13 by means of the separating grid 17 is returned to the hopper 10.

If the position for the engagement between the intermediate roller 13 and the separating grid 17 is located below a horizontal plane which passes through the axis of rotation of the roller 13, the separated toner can be easily removed from the grid 17 also by the effect of gravity. However, transporting the toner to the hopper 10 requires another transportation means, so that the apparatus is complicated in structure and increased in cost, and moreover, the dead toner increases. Accordingly, the engagement position must be located above the horizontal plane which passes through the axis of rotation of the intermediate roller 13. If this is done, however, the toner separated by means of the separating grid 17 cannot be transported to the hopper 10 on account of gravity.

In the present embodiment, therefore, the rationalization of the dead toner and the efficiency of transportation of the separated toner to the hopper 10 were able to be made compatible by adjusting an angle a of a plane which passes through the axis of rotation of the intermediate roller 13 and the position of engagement between the roller 13 and the separating grid 17 to the horizontal plane which passes through the axis of rotation of the roller 13, to a range from 0° to 45°.

When printing tests were conducted by using the image forming apparatus for the control described above, satisfactory images were able to be obtained even after printing of 10,000 copies.

Subsequently, printing tests were conducted under conditions (1) to (6) shown in Table 1, in order to observe the result of the separation of the toner from the intermediate roller 13 and the effect of spreading by means of the spreading auger portions 11*b* in the stirrer 11.

TABLE 1

| Test Conditions | Toner Separation Mode | Separating Grid | Spreading Auger |
|---|---|---|---|
| (1) | x | x | x |
| (2) | ○ | x | x |
| (3) | x | ○ | x |
| (4) | x | ○ | ○ |
| (5) | ○ | ○ | x |
| (6) | ○ | ○ | ○ |

The right-half side of a print chart used was printed with characters, and the left-half side was a white ground. Table 2 shows the results of evaluations on the solid follow-up performance after continuous printing of 10,000 copies.

Fogging and solid follow-up performance are defined as follows.

| |
|---|
| Fogging (%) |
| = (Reflectance of white paper) - (Reflectance of background portion of print image), |
| Solid follow-up performance (%) |
| = (Density at about 50 mm from leading end of wholly solid image) - (Density at about 50 mm from trailing end of wholly solid image). |

TABLE 2

| | Solid Density | | | | | | Fogging (%) (%) | |
|---|---|---|---|---|---|---|---|---|
| | 50 mm from leading end | | 50 mm from trailing end | | Follow-up performance | | | |
| Test Conditions | Left-half side | Right-half side | Left-half side | Right-half side | Left-half side | Right-half side | Left-half side | Right-half side |
| Initial condition | 1.46 | 1.46 | 1.45 | 1.45 | 99.3 | 99.3 | 0.3 | 0.2 |
| (1) | 1.42 | 1.23 | 1.36 | 1.04 | 95.8 | 84.6 | 0.6 | 4.8 |
| (2) | 1.42 | 1.32 | 1.37 | 1.20 | 96.5 | 89.6 | 0.6 | 3.0 |
| (3) | 1.42 | 1.24 | 1.37 | 1.08 | 96.5 | 87.1 | 0.6 | 4.0 |
| (4) | 1.42 | 1.28 | 1.37 | 1.12 | 96.5 | 87.5 | 0.5 | 3.3 |
| (5) | 1.43 | 1.33 | 1.38 | 1.23 | 96.6 | 92.5 | 0.7 | 1.7 |
| (6) | 1.42 | 1.40 | 1.38 | 1.36 | 97.2 | 97.2 | 0.8 | 1.0 |

Under condition (1) for no countermeasures, the solid density and solid follow-up performance were lowered, and fogging was caused on the unprinted right-half side after the threading of 10,000 paper sheets. After printing 10,000 copies under condition (1), the toner particle diameter distribution was determined for the toner on the developing roller 14, toner near the intermediate roller 13, and toner in the hopper 10 with respect to the left- and right-half sides of the developing unit, that is, at six spots in total (see Table 3).

For the initial toner particle diameter, the average volume particle diameter (Dv) is reduced, the particle diameter distribution is broad (Dv/Dn is high), and fine particles of 5 μm or less are increased, at any of the six spots. Although the distribution in the hopper 10 makes no substantial change, a remarkable distribution change is observed on the right-half side (no-print region) near the developing roller 14 and the intermediate roller 13. This is because the toner is smashed by a considerable stress as it passes the developing nip. On the left-half side, the toner is consumed by the developing operation, and the fresh toner is supplied from the hopper 10, so that the particle diameter distribution makes no substantial change, as compared with the case of the right-half side. If the particle diameter distribution is broad, and if the fine particles increase, then the charge distribution of the toner is broad too, and unelectrified and reversely electrified toner particles also increase, so that blushing is enhanced. If the fine particles increase, and if the average toner particle diameter becomes smaller, moreover, the fluidity of the toner lowers, and the solid follow-up performance worsens.

TABLE 3

| Conditions | Location of Measurement | Dr[pm] | Dn[pm] | Dr/Dn | before 5 pm |
|---|---|---|---|---|---|
| | Initial toner | 11.2 | 9.3 | 1.20 | 9.2 |
| Condition (1) | On developing roller (Left) | 10.6 | 7.3 | 1.36 | 16.2 |
| | On developing roller (Right) | 9.3 | 5.8 | 1.60 | 42.1 |
| | Near intermediate roller (Left) | 10.7 | 8.1 | 1.32 | 14.3 |
| | Near intermediate roller (Right) | 9.9 | 6.3 | 1.57 | 30.0 |
| | Hopper (Left) | 10.7 | 8.8 | 1.21 | 10.8 |
| | Hopper (Right) | 10.6 | 8.4 | 1.26 | 13.5 |
| Condition (6) | On developing roller (Left) | 10.2 | 8.0 | 1.21 | 17.6 |
| | On developing roller (Right) | 9.9 | 7.8 | 1.24 | 18.2 |
| | Near intermediate roller (Left) | 10.4 | 8.5 | 1.22 | 15.4 |
| | Near intermediate roller (Right) | 10.2 | 8.1 | 1.26 | 18.0 |
| | Hopper (Left) | 10.5 | 8.7 | 1.23 | 12.5 |
| | Hopper (Right) | 10.4 | 8.7 | 1.20 | 12.7 |

The average charge on the toner is 9.7 μc/g for the right-half side and 6.5 μc/g for the left-half side, indicating the predominance of the right-half side. This is because the same toner is repeatedly subjected to frictional charging by means of the blade 15, and therefore, the toner is charged up. Thus, the image density is lowered.

It was found that there are the following three problems on the right-half side (no-print region) after the end of printing of 10,000 copies.

(a) Charge-up of toner Lower image density (b) Production of fine particles of smashed toner→ Lower fluidity→Lower solid follow-up performance (c) Production of fine particles of smashed toner→ Production of reversely electrified toner→Fogging Under condition (1), the separation of the toner from the developing roller 14 is caused only by the mechanical scraping by means of the intermediate roller 13, and the toner is not separated from the intermediate roller 13 at all. Accordingly, the toner is never delivered to or from the hopper 10 unless the toner on the developing roller 14 is consumed to require new toner supply. On the right-half side, therefore, the toner is charged up, and the fine toner particles concentrate on the region near the intermediate roller 13, thus arousing the aforesaid problems on the right-half side after the end of life tests.

Under condition (2) in which only the separation of the toner from the developing roller 14 is accomplished, the toner is prevented from being charged up, so that the density lowering is considerably restrained. In this case, however, the separated toner is immediately fed to the developing roller 14 without being separated from the intermediate roller 13. Accordingly, the fine toner particles rush to the vicinity of the rollers 14 and 13, so that the inadequate solid follow-up performance is not improved much. Under condition (3) in which only the effect of mechanical scraping by means of the intermediate roller 13 is used for the toner separation from the developing roller 14, and in which the separating grid 17 is used for the toner separation from the roller 13, the toner separation from the developing roller 14 is unsatisfactory. In this case, therefore, only the lowered image density on the right-half side, lowered solid follow-up performance, and increased fogging are improved. Under condition (4) in which use of the spreading auger portions 11*b* is added to condition (3), therefore, there is no substantial difference in improvement from the case of condition (3). Under condition (5) which combines conditions (2) and (3), the toner is separated satisfactorily, and the charge-up of the toner and the concentration of the fine toner particles on the regions near the developing roller 14 and the intermediate roller 13 are restrained considerably. Since stirring the toner is not satisfactory with respect to the lateral direction, however, the particle diameter distribution on the right-half side is broader than that on the left-half side, so that fogging on the right-half side and inadequate solid follow-up performance remain. Under condition (6), the toner separation from the developing roller 14, toner separation from the intermediate roller 13, and lateral toner stirring are carried out, and satisfactory images can be obtained even after life tests on 10,000 copies.

As seen from the examination results described above, the life of the developing unit can be extended by providing the means for separating the toner from the developing roller 14 and the mechanism for satisfactorily spreading and stirring the separated toner in the hopper 10.

All the toner image formed on the photoconductive drum 1 is not transferred to the paper P, and partially remains in the form of residual toner particles.

In the cleanerless process, no exclusive-use cleaning device is used to remove the residual toner particles. After the latent image on the photoreceptor drum 1 is erased by the electrifier (LED) 7, the residual toner particles are disturbed to be patternless and indistinguishable by the developer disturbing member 42. The disturbing member 42 erases a memory for the next print by erasing the pattern without recovering the toner.

Figure 8:
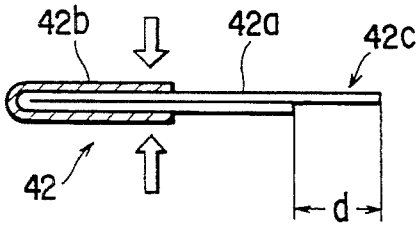
Figure 9:
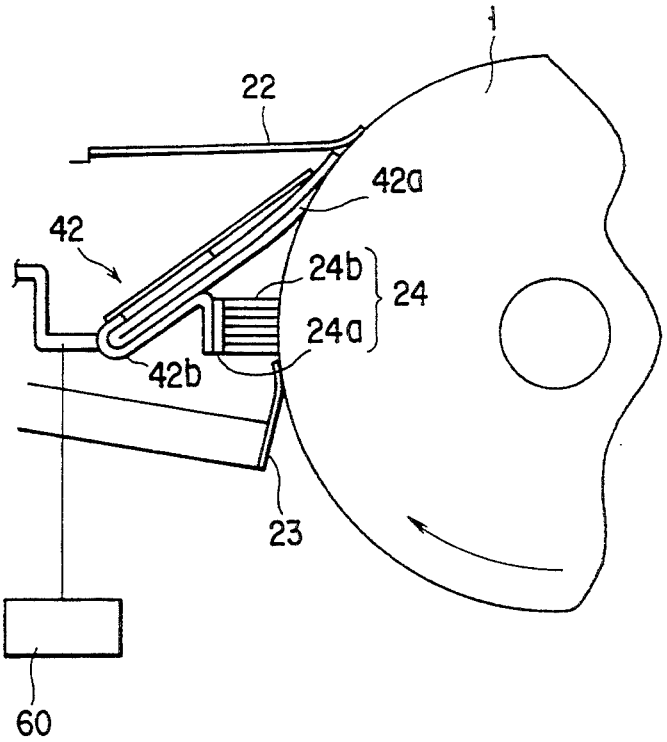

As shown in FIGS. 8 and 9, the developer disturbing member 42 is formed of a doubled brush 2*a* and an aluminum sheet 42*b* sandwiching the brush 2*a*. The brush 42*a* has an offset portion 42*c* at its distal end portion. The member 42 is located so that the distal end portion of the brush 42*a* is in contact with the photoconductive drum 1.

A nip is formed in the region of contact with the photoconductive drum 1 by changing the length of the brush 42*a*, so that satisfactory disturbing performance can be enjoyed by the use of a very simple, low-cost arrangement. The brush 42*a*, which includes the offset portion 42*c* in the region of contact with the drum, serves practically as a buffer which more or less stores the toner in its offset portion 42*c*. Thus, the offset portion 42*c* has a great influence on the cleaning action for the removal of jamming or after high-density pattern printing. An experiment was conducted with the length of the offset portion 42*c* varied. The experimental result indicates that operation after solid printing or for the removal of jamming can be satisfactorily accomplished if the length d is mm or more, preferably 3 mm or more.

The image memory can be erased well by means of the brush 42*a* if the brush has the specific resistance of $10^3$ to $10^9$ Ω.cm, thickness of 200 to 800 D/100 F, density of 5,000 to 200,000 fibers/inch. A bias source 60 is connected to the brush 42*a* so that a DC bias of 500 to 1,000 V or a DC-superposed AC bias (effective value: 250 to 600 V, frequency: 200 to 2 kHz) is applied to the brush, thereby making the residual toner particles electrically patternless and preventing production of a memory image.

As shown in FIGS. 1 and 9, a smoothing member 22 is located on the lower-course side of the disturbing member 42 with respect to the rotating direction of the photoconductive drum 1. The smoothing member 22 is formed of, for example, a urethane rubber sheet which is brought close to or into contact with the drum 1. The member 22 fulfills its function when a large quantity of residual toner passes the brush 42*a* during the removal of jamming or at the start of operation of the drum 1. More specifically, the brush 42*a* restores the toner to the photoconductive drum 1 after temporarily storing it when the storable quantity of toner for the brush 42*a* is exceeded as plenty of residual toner passes the brush 42*a*, therefore, unelectrified toner particles drop in lumps onto the photoconductive drum 1. The lumps of toner having passed the brush 42*a* may cause irregular electrification or intercept light in an exposure region. Thus, cleaning cannot be effected in the developing region, so that the toner lumps appear in the image. According to the present embodiment, defective images can be prevented by leveling and smoothing the toner lumps by means of the smoothing member 22.

Further, a sheet-like toner drop preventive member 23 is provided between the developer disturbing member 42 and the transfer charger 6 on the upper-course side of the member 42 with respect to the rotating direction of the photoconductive drum 1. The flat of the preventive member 23 is in contact with the drum 1. The drop preventive member 23 allows the residual toner particles adhering to the surface of the drum 1 and the toner image formed in case of emergency, such as jamming, to pass without being scraped off, and receives toner particles dropped from the brush 42*a* by gravity. Thus, the toner is prevented from dropping onto the paper p.

As shown in FIG. 1, the printer according to the present embodiment is of a lower-pass type such that the paper P passes under the photoconductive drum 1. In this case, the position where the toner drop preventive member 23 engages the drum 1 is situated between the developer disturbing member 42 and the transfer charger 6, in order to receive the toner dropped from the disturbing member 42. In the case of an upper-pass type such that the paper P passes over the drum 1, however, the engagement position is situated between the disturbing member 42 and the sconotron charger 43.

Thus, in the developing/cleanerless process, paper dust from the paper P causes a defective image besides the image memory because of the absence of a cleaner. In a process using a cleaner, paper dust adhering to the photoconductive drum 1 having passed the transfer region is recovered together with the residual toner particles by means of the cleaner. In the cleanerless process, on the other hand, some of the paper dust is attracted to the brush 42*a*, while the greater part reaches the developing/cleaning device 2 to be recovered thereby.

If the paper dust attracted to the brush 42*a* increases, the function of the brush 42*a* to attract and release the residual toner particles from the photoconductive drum 1 is retarded, and the attracted paper dust is suddenly released in lumps from the brush 42*a* onto the drum 1 by disturbance, such as vibration of the apparatus, thereby greatly influencing the developing/ cleaning effect, which will be mentioned later. Thus, according to the present embodiment, a dust seizing member 24 is disposed in contact with the surface of the photoconductive drum 1, on the upper-course side or just short of the brush 42*a* with respect to the rotating direction of the drum 1.

The seizing member 24 allows the residual toner particles attached to the photoconductive drum 1 to pass as much as possible, and seizes the paper dust only. With use of this member 24, the attraction of the paper dust to the brush 42*a* can be minimized, and therefore, the introduction of the paper dust into the developing/-cleaning device 2 can be reduced.

As shown in FIG. 9, the seizing member 24 is composed of a vinyl chloride base 24*a* and an acrylic-fiber brush 24*b* of 4-mm length fixed to the base 24*a*. The member 24 is attached to the aluminum sheet 42*b* of the disturbing member 42. By thus forming the members 24 and 42 integrally with each other, these members can be easily positioned with respect to the photoconductive drum 1.

Figure 10:
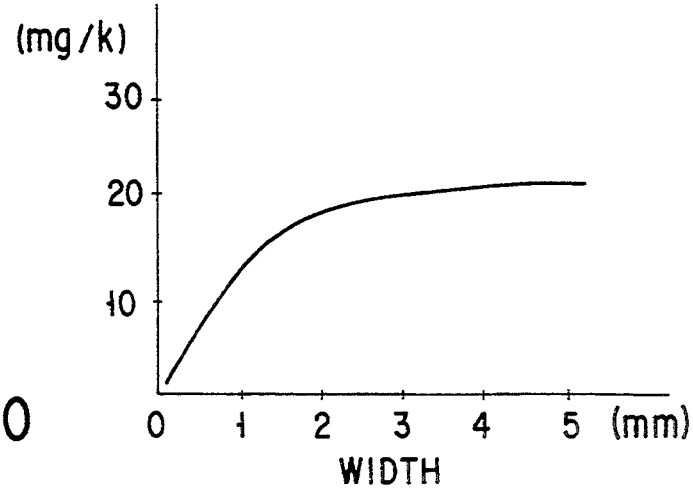

FIG. 10 shows the amount of removed paper dust compared with the width of the fiber brush 24*b* (width of the surface of contact with the photoconductive drum 1). As seen from this drawing, a satisfactory amount of removed paper dust can be obtained if the width of the brush 24*b* is 2 mm or more. The brush 24*b* used in the present embodiment is 4 mm wide.

Further, the seizing member 24 is located so that the fiber brush 24*b* bites the photoconductive drum 1 to the depth of about 0.6 mm, that is, the brush is pressed against the drum 1 with a force such that the distal end portion of the brush is deformed for a length of about 0.6 mm. If the depth of bite of the fiber brush 24*b* in the drum 1 is too great, the toner is also removed. If the depth of bite is too small, the residual toner particles and the paper dust are all passed. A satisfactory result was obtained when the depth of bite were set within the range of 0.3 to 1 mm.

Figure 11A:
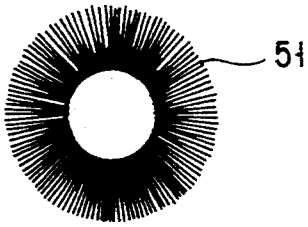
FIG. 11A is a side view showing a modification of the paper dust seizing member.

Although the fixed brush is used as the seizing member 24 according to the present embodiment, it may be replaced with a roller-type rotating brush 51 which is supported for rotation, as shown in FIG. 11A. The use of the rotating brush 51 may extend the life of the seizing member.

Figure 11B:
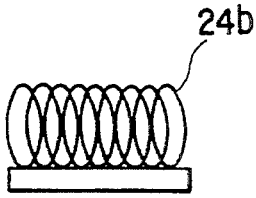
FIG. 11B is an enlarged view of a brush portion of the seizing member.

Although an acrylic-based material is used for the fiber brush 24*b*, the paper dust seizing effect may be increased by using very fine fibers, such as TORAYCA, TORAYSEE (trademark), etc., or by using a pile fabric structure, as shown in FIG. 11B.

The paper contains particulate materials called loading materials. In general, calcium carbonate, talc, kaolin, etc. may be used as the loading materials. Among these materials, talc and kaolin are liable to be negatively electrified, and calcium carbonate to be positively electrified.

Table 4 shows the result of measurement of blow-off charge on the toner and loading materials.

TABLE 4

| Object of measurement | Electric charge (μc/g) |
|---|---|
| Toner: | −27.2 |
| Talc: | −42.0 |
| Kaolin: | −35.7 |
| Calcium carbonate: | +19.6 |
| Instrument: | Blow-off charge measuring device (from Toshiba Chemicals Co., Ltd.) |
| Carrier: | POWDERTECH FSL-1020 from |
| Mixture ratio: | 3% by weight |

As seen from Table 4, if paper containing talc and kaolin as the loading materials is printed with use of the negatively charged toner as in the case of the present embodiment, the toner is electrified to the opposite polarity (+) through frictional charging with the mixed loading materials, and the resulting images are subject to fogging.

Figure 12:
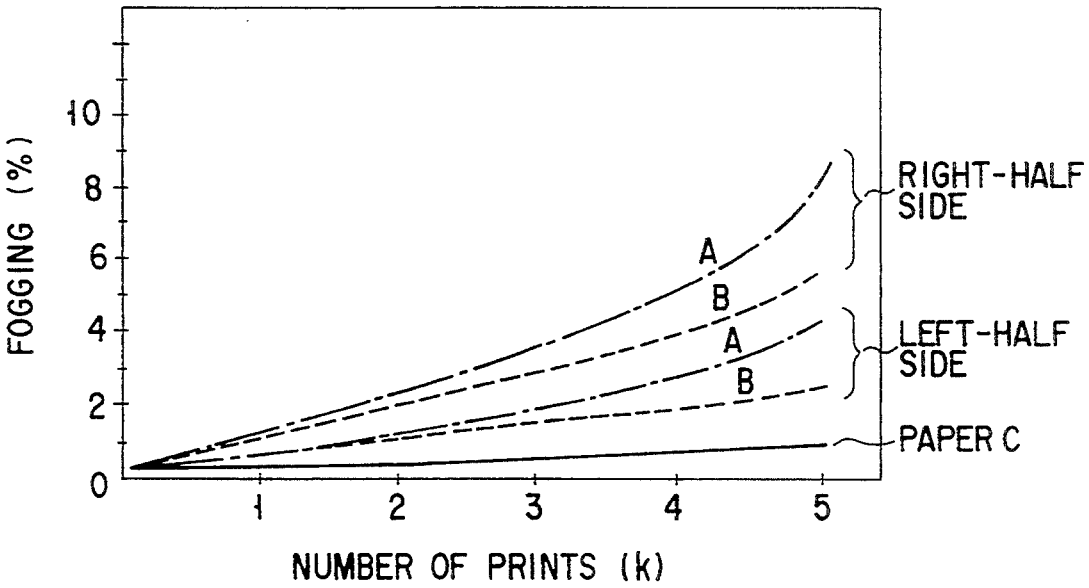

FIG. 12 shows the results of 5,000-copy running tests conducted by operating the developing unit under condition (1) of Table 1 and using paper A (loaded with talc), paper B (loaded with kaolin), and paper C (loaded with calcium carbonate).

As in a running test for a cleaner-based process, the apparatus was threaded with papers whose right-half side was a no-print region. Papers A and B suffered fogging on the unprinted right-half side, and exhibited no substantial difference from paper C on the left-half side.

Figure 13:
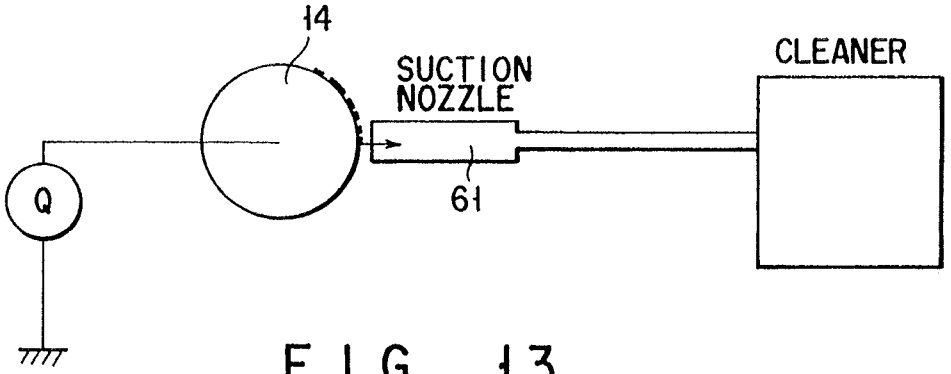

The electric charge on the toner on the developing roller 14 after the end of printing of 5,000 copies was determined by using a suction-type charge measuring device, such as the one shown in FIG. 13. This device determines a mirror-image charge which dies away as the toner is sucked into a nozzle 61. After papers A and B were passed, the charge on the right-half side was extremely low.

The electric charge on the blushed toner on the photoconductive drum 1 was determined by using the same suction-type charge measuring device. Thereupon, it was indicated that the polarity of the toner was positive, and that the toner included a number of particles with their polarity inverted by frictional charging between the paper dust (or loading materials therein) and the toner.

The talc contents of the toner at various parts of the developing unit were measured at the end of the test for paper A. Thereupon, it was indicated that the talc contents of the toner particles on the right-half side of the developing roller 14, toner particles in the intermediate roller 13, and toner particles in the region surrounded by the developing roller 14, blade 14, and intermediate roller 13 are much higher than those of the toner particles in any other places.

As mentioned before, the cleanerless process is subject to severe conditions, suffering a combination of the lowered solid density, lowered follow-up performance, and fogging which are attributable to the paper dust, as well as the lowered solid follow-up performance and fogging which are attributable to the change of the particle diameter distribution of the one-component developing agent. Life tests of 5 k half-side print charts having prints on the right-half side were conducted under conditions (1) to (6) for the developing unit shown in Table 1, by means of a machine using the cleanerless process. Tables 5 and 6 shows the results of these tests.

TABLE 5

| Location of Measurement | Content (% by weight) Condition (1) | Condition (6) |
|---|---|---|
| Toner layer on developing roller | 0.087 | 0.008 |
| Toner near blade | 0.079 | 0.007 |
| Toner clogging intermediate roller | 0.105 | 0.012 |
| Toner in hopper | 0.001 | 0.006 |

separating grid 17 to effect electrical separation. Item (7) of Table 6 indicates the result of a test on 5,000 copies for this case. It is seen that this test result is better than the result of item (6) based on the mechanical separation only.

Even after printing tests on 10,000 copies, moreover, satisfactory images with fogging of 1% or less were able to be obtained. It is known that good results can be obtained if a DC-superposed AC bias is used as the grid bias.

If the difference in potential between the intermediate roller 13 and the separating grid 17 is made so great that the separating capability of the grid 17 is too high, however, the ability of the intermediate roller 13 as toner supply means lowers, thus worsening the solid follow-up performance.

When the bias supplied to the intermediate roller 13 was adjusted to −270 V in the present embodiment, the grid bias (DC bias voltage for the case of AC application) exceeding −100 V (on the positive side) resulted in unsatisfactory solid follow-up performance.

The life performance of the apparatus can be improved by thus combining the electrically proper separating effect with the mechanical scraping effect of the grid 17.

Thus, it is necessary only that a mechanism for lateral stirring be provided in the course of the toner which is supplied again to the developing roller 14 via the hopper 10 after being separated from the roller 14.

In the cleanerless process, in particular, the paper dust greatly influences the toner charge, as mentioned before, so that it is essential to take a measure to remove the paper dust in the path of its invasion, as well as a

TABLE 6

| Test Conditions | Results of Continuous Threaded Tests on One-Component Cleanerless Process: Solid Density: 50 mm from leading end, Left-half side | 50 mm from leading end, Right-half side | 50 mm from trailing end, Left-half side | 50 mm from trailing end, Right-half side | Follow-up performance, Left-half side | Follow-up performance, Right-half side | Fogging (%) (%), Left-half side | Fogging (%) (%), Right-half side |
|---|---|---|---|---|---|---|---|---|
| Initial condition | 1.46 | 1.46 | 1.45 | 21.45 | 99.3 | 99.3 | 0.3 | 0.2 |
| (1) | 1.30 | 1.12 | 1.22 | 0.36 | 93.8 | 76.8 | 3.2 | 3.6 |
| (2) | 1.37 | 1.20 | 1.30 | 1.06 | 94.9 | 88.3 | 1.8 | 3.4 |
| (3) | 1.35 | 1.16 | 1.26 | 0.98 | 93.3 | 84.5 | 2.6 | 5.0 |
| (4) | 1.34 | 1.21 | 1.22 | 1.10 | 91.0 | 90.9 | 2.9 | 4.0 |
| (5) | 1.40 | 1.29 | 1,34 | 1.18 | 95.7 | 91.5 | 0.7 | 1.9 |
| (6) | 1.39 | 1.36 | 1.34 | 1.30 | 96.4 | 95.6 | 0.8 | 1.0 |
| (7) | 1.40 | 1.39 | 1.38 | 1.36 | 98.6 | 97.8 | 0.8 | 0.8 |

Also in the cleanerless process, it was indicated that satisfactory images were able to be obtained even after printing of 5,000 copies by transferring the toner from the developing roller 14 to the intermediate roller 13 in the toner recovery mode, separating the toner from the intermediate roller 13 by means of the separating grid 17, and laterally spreading the toner by means of the auger 11*b* in the developing container 3.

There were hardly any differences in the talc content between the individual regions. After tests on 10,000 copies, as in the case of the cleaner-based process, however, fogging exceeding 1% occurred.

In Table 6, items (1) to (6) indicate results obtained when the separating grid 17 was caused to engage the intermediate roller 13 in a floating state without being supplied with a bias, and the separation of the toner from the roller 13 was based a mechanical scraping effect. Thereupon, a bias of −150 V was applied to the measure for the developing/cleaning device 2 itself.

Figure 14:
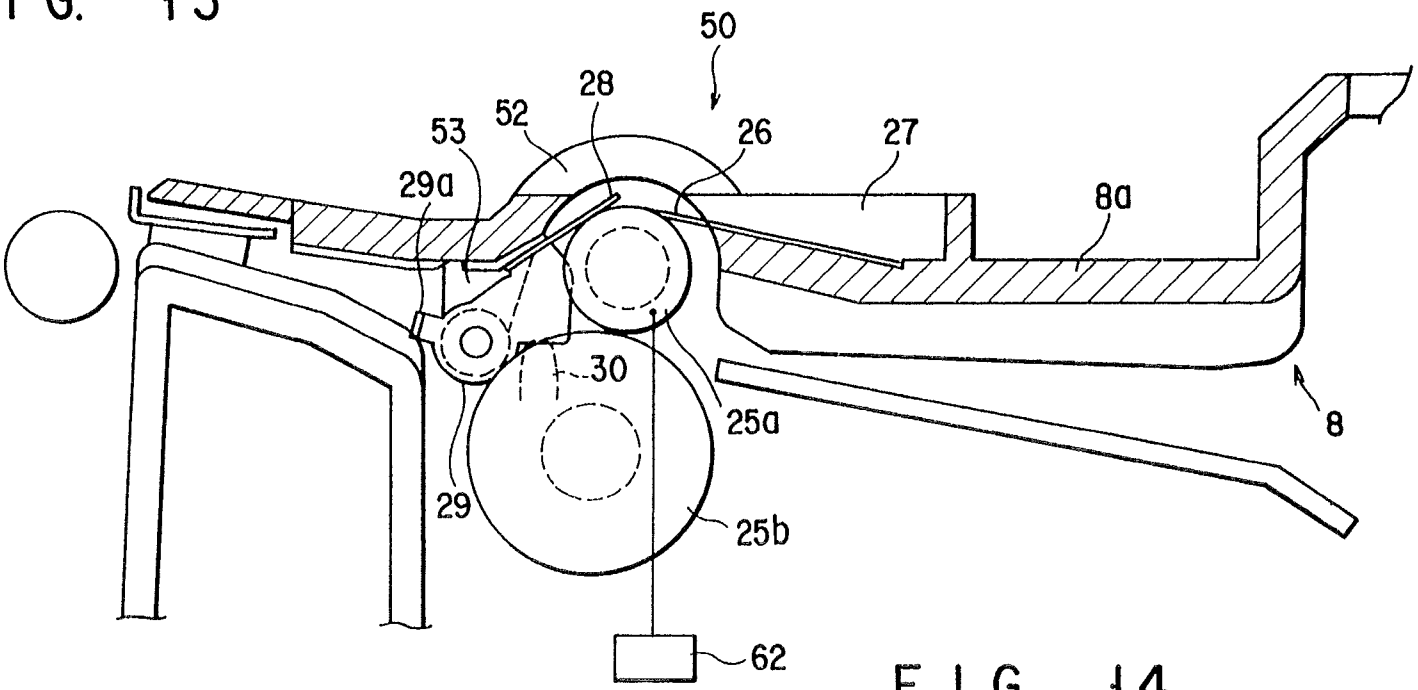

According to the present embodiment, therefore, the process unit 8 is provided with a dust removing mechanism 50 which is used to remove the paper dust adhering to aligning rollers for transporting the paper, as shown in FIGS. 1 and 14.

A bottom wall 8*a* of the process unit 8 is formed having a recess 52 which opens into the unit. When the process unit is set in the printer body, an upper aligning roller 25*a* which, out of a pair of aligning rollers 25*a* and 25*b* in rolling contact with each other, is in engagement with the print surface of the paper is located in the recess 52. The removing mechanism 50 includes a sheet-like removing member 26, which is fixed to the inner surface of the bottom wall 8*a* of the unit 8, and whose distal end portion projects into the recess 52. Thus, when the process unit 8 is set in the printer body, the removing member 26 comes into contact with the circumferential surface of the aligning roller 25*a*. As the roller 25*a* rotates, the member 26 scrapes and removes the paper dust from the circumferential surface of the roller 25*a*.

A dust storage section 27 is provided on the inner surface side of the bottom wall 8*a* of the process unit 8. The storage section 27, which adjoins the removing member 26, communicates with the recess 52. The paper dust removed from the aligning roller 25*a* by means of the removing member 26 is delivered to the dust storage section 27 to be stored therein. The capacity of the storage section 27 is larger than a capacity equivalent to the volume of the paper dust removed from paper sheets of a number corresponding to the life of the process unit 8.

A fiber brush formed of acrylic fibers may be used as the removing member 26. However, the fiber brush collects paper dust, and its removing capability is inevitably lowered to a marked degree when the paper dust is accumulated to a saturated state. Accordingly, it is desired that the removing member 26 should be formed of a sheet material. However, a metallic sheet material, such as stainless steel, may possibly damage the roller. Preferably, therefore, the member 26 should be formed of a resin sheet, such as polyethylene. Preferably, moreover, the removing member 26 should be arranged so that its distal end edge abuts against the aligning roller 25*a*. This arrangement can be expected to improve the effect of paper dust removal.

If the resin sheet is too thin, it is so weak that its paper dust removing capability is lowered. If the sheet is too thick, on the other hand, the removed paper dust cannot easily move to the dust storage section 27, and therefore, may possibly drop into the printer body as the process unit 8 is removed from the printer body.

When the amount of paper dust removed by changing the thickness of the resin sheet and the amount of paper dust dropped as the process unit was removed were evaluated. Thereupon, satisfactory results were obtained when the thickness of the resin sheet ranged from 0.05 to 0.5 mm.

The removing member 26 has electrical conductivity. As shown in Table 7, the effect of paper dust removal can be enhanced, and adhesion of the paper dust to the removing member 26 can be prevented by applying a bias voltage from a bias source 62 to the roller 25*a* and applying a bias to the removing member through the roller 25*a*.

Data in Table 7 represent the case where the upper and lower aligning rollers 25*a* and 26*b* are formed of metal and rubber, respectively. The effect of paper dust removal can be expected to be further improved by systematically applying a bias voltage of about 800V to the roller 25*a*, which normally arouses no problem because the roller 25*a* is grounded. It is necessary, moreover, only that at least that side of the removing member 26 which faces the roller 25*a* be electrically conductive.

TABLE 7

| Amount of Removed Paper Dust after 2,000-Sheet Threading: | |
|---|---|
| Bias voltage | Amount of removed paper dust (mg) |
| Float | 20 |
| GND | 40 |
| 400 V | 45 |
| 800 V | 50 |

Figure 15:
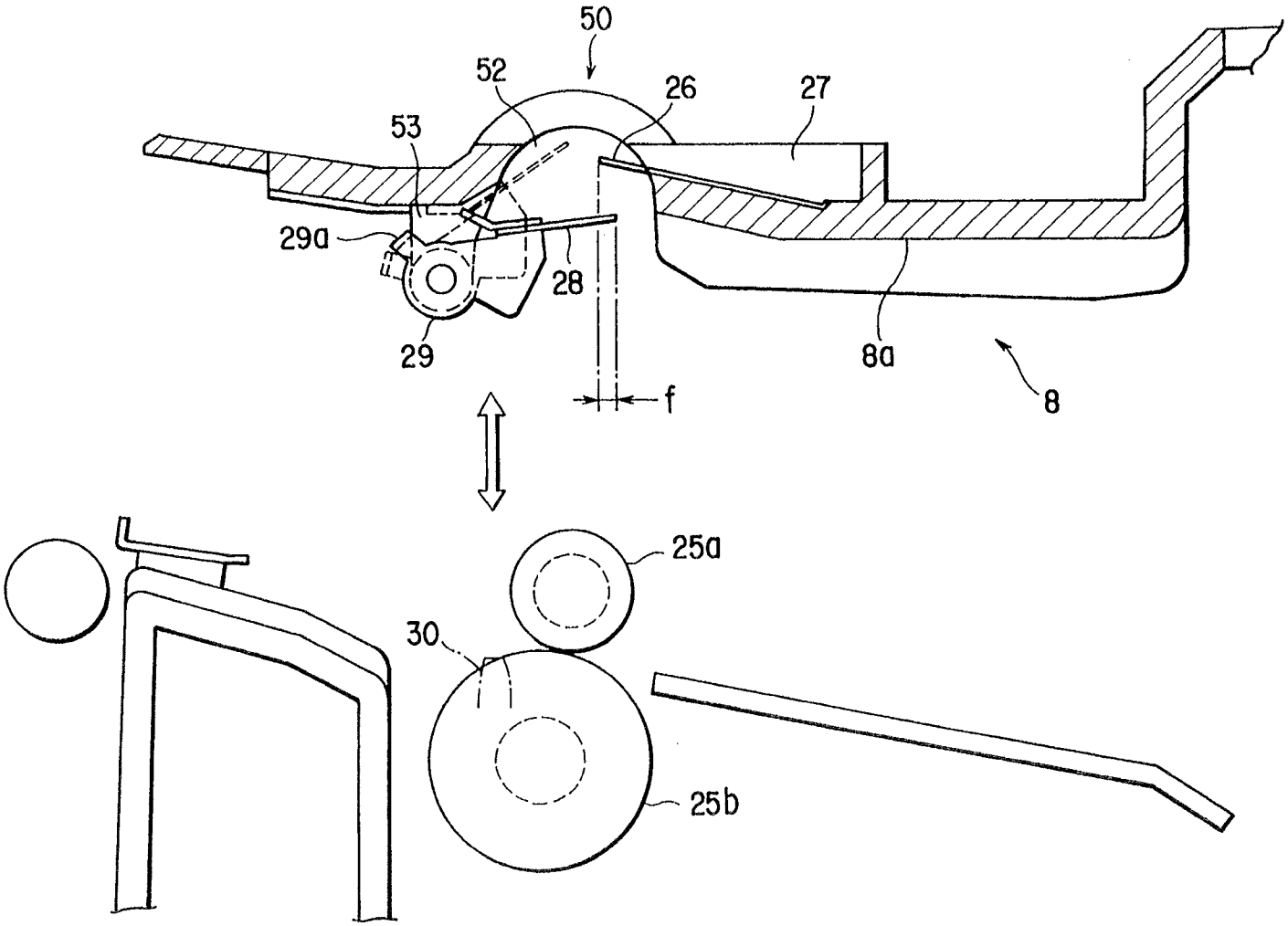

In the case where the sheet-like removing member 26 is used, the removed paper dust inevitably drops when the process unit 8 is removed from the printer body. According to the present embodiment, therefore, the dust removing mechanism 50 is provided with a shutter member 28 for opening and closing the dust storage section 27 as the process unit 8 is attached and detached. The member 28, which is formed of a sheet weaker than the removing member 26, e.g., a urethane sheet with a thickness of 0.2 mm, is fixed to a retaining member 29, as shown in FIGS. 14 and 15. The retaining member 29 is rockably supported on a stem 53, which is fixed to the bottom wall 8*a* of the process unit 8. Thus, the shutter member 28 is located on the opposite side of the recess 52 to the removing member 26, and is rocked between an open position shown in FIG. 14 and a close position shown in FIG. 15. The member 28 has a size such that its distal end does not engage the removing member 26 as it rotates, and that the distal end portion vertically overlaps the distal end portion of the member 26 for a predetermined length when in the close position.

When the process unit 8 is set in the printer body, a positioning projection 30 on the printer body pushes up the retaining member 29, so that the shutter member 28 is rocked to the open position, as shown in FIG. 14. In the open position, the flat of the shutter member 28 engages the roller 25*a*, and the distal end thereof is separated from the removing member 26 so that the recess 52 is open. When the process unit 8 is disengaged from the printer body, the retaining member 29 rocks downward by gravity, so that a stopper 29*a* on the member 29 abuts against the stem 53 to be stopped thereby, as shown in FIG. 5. When the shutter member 28 is rocked to the close position, it is situated under the removing member 26, and its distal end portion overlaps the member 26 for the predetermined length f, thereby closing the recess 52 or the storage section 27. Thus, in disengaging the process unit 8, the removed paper dust can be prevented from dropping from the paper storage section 27.

A good result was obtained when the overlap length f was adjusted to about 1 to 2 mm. Further, the shutter member 28 is formed of a weak sheet, and its flat engages the roller 25*a*, so that the paper dust adhering to the roller 25*a* can reach the removing member 26 and be securely seized in the dust storage section 27 without being separated by the member 28.

According to the printer constructed in this manner, the dust removing member 26 and the dust storage section 27 for storing the paper dust removed by the member 26 are arranged in the process unit 8. Accordingly, the dust removing capability is improved, and the removing mechanism 50 can be automatically replaced with a new one when the process unit is changed.

The storage capacity of the dust storage section 27 is larger than the capacity equivalent to the volume of the paper dust removed from paper sheets of the number corresponding to the set life of the process unit 8. Therefore, the paper dust never overflows the dust storage section 27 before the time for replacement, and all the dust removed by means of the removing member can be stored within the set life of the unit 8. The removing mechanism 50 can maintain a stable image quality for a long period of time throughout the life of the process unit 8, thus enjoying improved reliability.

Since the bias is applied to the metallic roller 25*a* of the transportation means through the removing member 26 in the process unit 8, the dust removing capability can be improved, and no special power supply member is required, thus resulting in reduction in cost.

Since the process unit is provided with the shutter member for opening and closing the dust storage section as the unit is attached or detached, moreover, the dust recovered in the dust storage section cannot be scattered to the outside while the unit is being attached or detached. Thus, the reliability can be further improved.

Further, the developer receiving member is provided for receiving the developing agent disturbed and dropped by the image disturbing member. Accordingly, the dropped developing agent can be prevented from scattering and soiling the apparatus.

Furthermore, the dust seizing member for seizing the dust adhering to the surface of the photoconductive drum is provided on the upper-course side of the image disturbing member and on the lower-course side of the transfer means. Thus, the dust transferred from the transfer medium to the drum can be seized efficiently.

The developing agent and the dust separated from the intermediate roller by means of the separating grid for use as the separating means are recovered into the developer storage section through the exclusive-use recovery path. By doing this, the separated dust can be fully blended with the developing agent by means of the stirrer, without being moved immediately to the intermediate roller, so that the influence of the dust can be minimized.

Accordingly, high-quality images free of irregular density, ground fogging, etc. can be obtained for a long period of time. In the cleanerless process, in particular, irregular electrification and exposure can be prevented so that the residual developing agent can be securely disturbed to be patternless. Thus, the apparatus can enjoy a prolonged life without suffering memories, irregular density, soiled images, etc.

According to the embodiment described above, the present invention is applied to the cleanerless process for one-component nonmagnetic contact developing. However, the invention is not limited to this embodiment, and it is necessary only that the developer supply means be provided with the separating means. For example, the developer supply/recovery means may alternatively be provided with conventional cleaning means for magnetic toners, non-contact developing, blade cleaning, etc.

According to the embodiment described herein, moreover, the process unit is composed of the electrostatic latent image bearing member, charger, and image disturbing means which are arranged integrally with one another. Alternatively, however, the process unit may be formed of an integral combination of a developing unit, cleaning means, transfer charger, discharge lamp, etc. In short, it is necessary only that the process unit be an integral combination of the latent image bearing member and at least one of those image forming means.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for forming an image on an image bearing member and transferring the image formed on said image bearing member onto a transfer medium, said apparatus comprising:

a process unit detachably mounted on said image forming apparatus and including said image bearing member, means for transporting the transfer medium to the image bearing member, first removing means for removing dust of the transfer medium attached to said transporting means, and first collecting means for collecting the dust removed from said transporting means by said first removing means;

means for forming the image on said image bearing member with developer;

transfer means for transferring the image formed on said image bearing member onto the transfer medium said transporting means including a roller which includes an electrically conductive material and is in rolling contact with the transfer medium, said process unit having an opening which communicates with the firs collecting means and faces the roller, and said first removing means including a removing member for removing the dust from the roller by coming into contact therewith and guiding the removed dust to the first collecting means through the opening, the removing member having an electrically conductive material and a resin sheet which includes an edge portion in contact with the circumferential surface of the roller;

means for applying a bias voltage to the roller;

second removing means for removing residual developer remained on the image bearing member after transfer of the image by said transfer means; and second collecting means for collecting the developer removed from said image bearing member by said second removing means.

2. The apparatus according to claim 1, wherein said first collecting means includes a storage capacity for storing the dust removed during the service life of the process unit.

3. The apparatus according to claim 1, wherein said process unit further includes said forming means, said second removing means, and said second collecting means.

4. The apparatus according to claim 1, wherein said first removing means includes shutter means for closing the opening to prevent the dust from dropping from the first collecting means when the process unit is removed.

5. The apparatus according to claim 4, wherein said shutter means includes a sheet-like shutter member attached to the process unit so as to be rockable between a close position in which the shutter member closes the opening in cooperation with the removing member and an open position in which the shutter member engages the roller to allow the opening to open.

6. An image forming for forming an image on an image bearing member and transferring the image formed on said image bearing member onto a transfer medium, said apparatus comprising:

a removable process unit including said image bearing member, image forming means for forming an image on the image bearing member, and means for transporting a transfer medium to the image bearing member;

removing means provided at the process unit, for removing dust from the transfer medium adhering to the transporting means collecting means provided at the process unit, for collecting the dust removed by the removing means; and means for closing the collecting means to prevent the dust from dropping from the collecting means when the process unit is removed.

7. An image forming apparatus for forming an image on an image bearing member and transferring the image formed on said image bearing member onto a transfer medium, said apparatus comprising:

a removable process unit including said image bearing member, image forming means for forming an image on the image bearing member, and means for transporting a transfer medium to the image bearing member, the transporting means having an electrically conductive roller;

means for applying a bias voltage to the roller;

removing means provided at the process unit, for removing dust from the transfer medium adhering to the roller, the removing means including an electrically conductive removing member in contact with the roller; and collecting means for collecting the dust removed by the removing means.

8. A developing device for developing an electrostatic latent image formed on an image bearing member, said device comprising:

a storage section stored with a developing agent;

developing means for supplying the developing agent to the image bearing member;

developer supply/recovery means for supplying the developing agent from the storage section to the developing means and recovering the developing agent remaining on the developing means after the image is developed by the developing means;

separating means abutting against the developer supply/recovery means, for separating the developing agent recovered by the developer supply/recovery means and dust from the developer supply/recovery means; and means for defining a recovery path through which the separated developing agent and dust are guided to the storage section.

9. The developing device according to claim 8, wherein said storage section has an opening opposed to the developer supply/recovery means and defining the recovery path, and said separating means includes a plate-like separating member located at the opening of the storage section and having a number of through holes in contact with the developer supply/recovery means and a plurality of reinforcing members arranged at a predetermined angle to the opening of the storage section with respective an axial direction of the developer supply/recovery means and with a gap between each reinforcing member and the separating member.

10. The developing device according to claim 9, wherein said separating member is formed of a meshed elastic sheet with a thickness of 0.1 to 0.5 mm.

11. The developing device according to claim 9, wherein said developing means includes a developing roller in rolling contact with the image bearing member, said developer supply/recovery means includes an intermediate roller in rolling contact with the developing roller, and said separating member is arranged so that a plane which passes through the position of contact between the intermediate roller and the separating member and a central axis of the intermediate roller is located at an angle of about 0° to 45° to a horizontal plane which passes through the central axis of the intermediate roller, and that the separating member is situated on a lower level than a top portion of the intermediate roller.

12. The developing device according to claim 8, wherein said developing means includes a developing roller in rolling contact with the image bearing member, and said developer supply/recovery means includes an intermediate roller in rolling contact with the developing roller, and which further comprises stirring means arranged in the storage section, for supplying the developing agent in the storage section to the intermediate roller and stirring the developing agent and the dust, recovered through the recovery path, in the axial direction of the intermediate roller.

13. The developing device according to claim 8, wherein said developing means includes a developing roller in rolling contact with the image bearing member, and said developer supply/recovery means includes an electrically conductive intermediate roller in rolling contact with the developing roller, and which further comprises first application means for applying a first voltage to the developing roller and second application means for alternatively applying a second voltage higher than the first voltage or a third voltage lower than the first voltage to the intermediate roller.

* * * * *